US006383065B1

(12) United States Patent
Grumbine et al.

(10) Patent No.: US 6,383,065 B1
(45) Date of Patent: May 7, 2002

(54) CATALYTIC REACTIVE PAD FOR METAL CMP

(75) Inventors: Steven K. Grumbine, Aurora, IL (US); Christopher C. Streinz, Patten, ME (US); Brian L. Mueller, Chandler, AZ (US)

(73) Assignee: Cabot Microelectronics Corporation, Aurora, IL (US)

( * ) Notice: Subject to any disclaimer, the term of this patent is extended or adjusted under 35 U.S.C. 154(b) by 0 days.

(21) Appl. No.: 09/766,759

(22) Filed: Jan. 22, 2001

(51) Int. Cl.[7] ..... B24D 11/00
(52) U.S. Cl. ..... 451/526; 451/539
(58) Field of Search ..... 451/526, 533, 451/539, 41

(56) References Cited

U.S. PATENT DOCUMENTS

| | | | | |
|---|---|---|---|---|
| 3,385,682 | A | | 5/1968 | Lowen |
| 3,668,131 | A | | 6/1972 | Banush et al. |
| 3,877,938 | A | | 4/1975 | Shinozaki et al. |
| 4,251,384 | A | | 2/1981 | Rooney |
| 4,671,851 | A | | 6/1987 | Beyer et al. |
| 4,696,697 | A | | 9/1987 | Kitano et al. |
| 4,728,552 | A | | 3/1988 | Jensen, Jr. |
| 4,789,648 | A | | 12/1988 | Chow et al. |
| 4,841,680 | A | | 6/1989 | Hoffstein et al. |
| 4,885,106 | A | | 12/1989 | Lapham et al. |
| 4,910,155 | A | | 3/1990 | Cote et al. |
| 4,927,432 | A | | 5/1990 | Budinger et al. |
| 4,929,257 | A | | 5/1990 | Miyazaki et al. |
| 4,944,836 | A | | 7/1990 | Beyer et al. |
| 4,954,141 | A | | 9/1990 | Takiyama et al. |
| 4,956,313 | A | | 9/1990 | Cote et al. |
| 4,959,113 | A | | 9/1990 | Roberts |
| 4,992,135 | A | | 2/1991 | Doan |
| 5,020,283 | A | | 6/1991 | Tuttle |
| 5,114,437 | A | | 5/1992 | Takeushi |
| 5,137,544 | A | | 8/1992 | Medellin |
| 5,157,876 | A | | 10/1992 | Medellin |
| 5,197,999 | A | | 3/1993 | Thomas |
| 5,209,816 | A | | 5/1993 | Yu et al. |
| 5,212,910 | A | | 5/1993 | Breivogel et al. |
| 5,225,034 | A | | 7/1993 | Yu et al. |
| 5,226,955 | A | | 7/1993 | Owaki |
| 5,244,534 | A | | 9/1993 | Yu et al. |
| 5,297,364 | A | | 3/1994 | Tuttle |
| 5,340,370 | A | | 8/1994 | Cadien et al. |
| 5,354,490 | A | | 10/1994 | Yu et al. |
| 5,391,258 | A | | 2/1995 | Brancaleoni et al. |
| 5,394,655 | A | | 3/1995 | Allen |
| 5,476,606 | A | | 12/1995 | Brancaleoni et al. |
| 5,489,223 | A | | 2/1996 | Cook et al. |
| 5,527,423 | A | | 6/1996 | Neville et al. |
| 5,575,837 | A | | 11/1996 | Kodama |
| 5,622,896 | A | | 4/1997 | Knotter et al. |
| 5,645,736 | A | | 7/1997 | Allman |
| 5,770,095 | A | | 6/1998 | Sasaki et al. |
| 5,783,489 | A | | 7/1998 | Kaufman et al. |
| 5,804,513 | A | | 9/1998 | Sakatani et al. |
| 5,827,781 | A | | 10/1998 | Skrovan et al. |
| 5,849,051 | A | | 12/1998 | Beardsley et al. |
| 5,849,052 | A | | 12/1998 | Barber |
| 5,860,848 | A | | 1/1999 | Loncki et al. |
| 5,948,697 | A | | 9/1999 | Hata |
| 5,958,288 | A | | 9/1999 | Mueller et al. |
| 5,980,775 | A | | 11/1999 | Grumbine et al. |
| 6,015,506 | A | * | 1/2000 | Streinz et al. ..... 252/186.1 |
| 6,062,968 | A | | 5/2000 | Sevilla et al. |
| 6,068,787 | A | | 5/2000 | Grumbine et al. |
| 6,063,306 | A | | 6/2000 | Kaufman et al. |
| 6,083,419 | A | * | 7/2000 | Grumbine et al. ..... 252/79.1 |
| 6,136,711 | A | * | 10/2000 | Grumbine et al. ..... 438/692 |
| 6,217,416 | B1 | | 4/2001 | Kaufman et al. |

FOREIGN PATENT DOCUMENTS

| | | |
|---|---|---|
| EP | 0 401 147 | 12/1990 |
| EP | 0 708 160 | 4/1996 |
| GB | 2 247 892 | 3/1992 |
| WO | WO 95 24054 | 9/1995 |
| WO | WO 96 16436 | 5/1996 |

OTHER PUBLICATIONS

DuPont Oxone® Monopersulfate Compound, Oxone Monopersulfate Compound, pp. 1–6 (1994).
Analysis of Slurry MSW1000 manufactured by Rodel, Inc. (Oct. 27, 1995).
Cabot Corporation Semi–Sperse™ W–A355 Polishing Slurry for Tungsten CMP product literature.
Cabot Corporation Semi–Sperse™ FE–10 Oxidizer Solution for Tungsten CMP product literature.
Patent Abstracts of Japan, publication No. 6342782, publication date Nov. 11, 1988.

* cited by examiner

*Primary Examiner*—Joseph J. Hail, III
*Assistant Examiner*—David B. Thomas

(57) ABSTRACT

A polishing pad including a polishing pad substrate and a catalyst having multiple oxidation states wherein the catalyst containing polishing pad is used in conjunction with an oxidizing agent to chemically mechanically polish metal features associated with integrated circuits and other electronic devices.

40 Claims, No Drawings

CATALYTIC REACTIVE PAD FOR METAL CMP

BACKGROUND OF THE INVENTION (1) Field of the Invention

This invention concerns a polishing pad including a polishing pad substrate and catalyst having multiple oxidation states. This invention also concerns a method for using a catalyst containing polishing pad in conjunction with an oxidizing agent to chemically mechanically polish metal layers associated with integrated circuits and other electronic devices wherein the catalyst is a metal catalyst or a catalyst having multiple oxidation states.

(2) Description of the Art

A semiconductor wafer typically includes a substrate, such as a silicon or gallium arsenide wafer, on which a plurality of integrated circuits have been formed. Integrated circuits are chemically and physically integrated into a substrate by patterning regions in the substrate and layers on the substrate. The layers are formed of various materials having either a conductive, insulating or semiconducting nature. In order to produce devices in high yields, it is crucial to start with a flat semiconductor wafer. As a result, it is often necessary to polish semiconductor wafers to obtain flat surfaces. If the process steps of device fabrication are performed on a wafer surface that is not planar, various problems can occur which may result in a large number of inoperable devices. For example, in fabricating modern semiconductor integrated circuits, it is necessary to form conductive lines or similar structures above a previously formed structure. However, prior surface formation often leaves the top surface topography of a wafer highly irregular, with bumps, areas of unequal elevation, troughs, trenches and other similar types of surface irregularities. Global planarization of such surfaces is necessary to ensure adequate depth of focus during photolithography, as well as removing any irregularities and surface imperfections during the sequential stages of the fabrication process.

Although several techniques exist to ensure wafer surface planarity, processes employing chemical mechanical planarization or polishing techniques have achieved widespread usage. The polishing planarization techniques planarize the surface of wafers during the various stages of device fabrication and improve yield, performance and reliability. In general, chemical mechanical polishing ("CMP") involves the circular motion of a wafer under a controlled downward pressure with a polishing pad saturated with a chemically-active polishing composition.

In order for CMP and other polishing techniques to provide effective planarization, the delivery of a polishing composition to the surface being polished becomes important. Chemical mechanical polishing compositions typically include a variety of ingredients including, oxidizing agents, film forming agents, corrosion inhibitors, abrasives, and so forth. Recently issued U.S. Pat. No. 5,958,288 discloses polishing compositions including catalysts having multiple oxidation states, the specification of which is incorporated herein by reference in it entirety.

The incorporation of abrasive particles into polishing pads is disclosed in several U.S. Patents including U.S. Pat. Nos. 5,849,051 and 5,849,052, the specifications of which are also incorporated herein by reference. In addition, solid metal catalysts have been incorporated into polishing pads as described in U.S. Pat. No. 5,948,697. The catalysts incorporated into polishing pads described in the '697 patent are used to catalyze semiconductor polishing upon application of an electrical bias to the semiconductor.

Despite these advances to chemical mechanical polishing compositions and polishing pads, there remains a need for polishing pads with improved polishing performance. There is also a need for new methods to polish integrated circuit layers and other electronic components that are reliable and reproducible.

SUMMARY OF THE INVENTION

This invention includes a polishing pad useful for chemical mechanical polishing comprising a polishing pad substrate and at least one catalyst having multiple oxidation states.

This invention also includes a polishing pad useful for chemical mechanical polishing comprising a polishing pad substrate, an abrasive, a soluble catalyst including a metal having multiple oxidization states selected from iron and copper that catalyzes the reaction of an oxidizing agent and the metal of a substrate metal feature being polished.

This invention further includes a method for polishing a metal feature on a substrate surface. The method includes the steps of preparing a polishing pad by combining a polishing pad substrate with at least one catalyst having multiple oxidation states. The catalyst containing polishing pad is then brought into contact with the metal feature of a substrate being polished. An oxidizing agent is applied to the catalyst containing polishing pad either before the pad is brought into contact with the metal feature being polished, or as the catalyst containing polishing pad is used to polish the substrate metal feature, or both. The catalyst containing polishing pad is moved in relationship to the substrate metal feature until a desired amount of metal is removed from the substrate metal feature.

DESCRIPTION OF THE CURRENT EMBODIMENT

The present invention relates to catalyst containing polishing pads that include a polishing pad substrate and at least one catalyst having multiple oxidation states. The catalyst containing polishing pads are useful for the chemical mechanical polishing (CMP) of one or more metal features associated with integrated circuits and other electronic devices.

The catalyst containing polishing pads of this invention include a polishing pad substrate and at least one catalyst. The polishing pad substrate may be any type of polishing pad substrate that are useful for CMP. Typical polishing pad substrates available for polishing applications, such as CMP, are manufactured using both soft and/or rigid materials and may be divided into at least four groups: (1) polymer-impregnated fabrics; (2) microporous films; (3) cellular polymer foams and (4) porous sintered-subtrates. For example, a pad substrate containing a polyurethane resin impregnated into a polyester non-woven fabric is illustrative of the first group. Polishing pad substrates of the second group consist of microporous urethane films coated onto a base material which is often an impregnated fabric of the first group. These porous films are is composed of a series of vertically oriented closed end cylindrical pores. Polishing pad substrates of the third group are closed cell polymer foams having a bulk porosity which is randomly and uniformly distributed in all three dimensions. Polishing pad substrates of the fourth group are opened-celled, porous substrates having sintered particles of synthetic resin. Representative examples of polishing pad substrates useful, in the present invention, are described in U.S. Pat. Nos. 4,728,552, 4,841,680, 4,927,432, 4,954,141, 5,020,283, 5,197,999, 5,212,910, 5,297,364, 5,394,655, 5,489,233 and 6,062,968, each of the specifications of which are incorporated herein in their entirety by reference.

The polishing pad substrates used in the present invention may be any one of the substrates described above. In addition, the polishing pad substrate may be made from a material other than a polymer such as cellulose fabric or any other materials that are known in the art to be useful for chemical mechanical polishing. What is important is that the polishing substrate chosen must be capable of being combined with at least one catalyst to form a catalyst containing polishing pad.

The polishing pads of this invention include at least one catalyst. The purpose of the catalyst is to transfer electrons from the metal of a substrate metal feature being oxidized to the oxidizing agent (or analogously to transfer electrochemical current from the oxidizer to the metal). The catalyst or catalysts chosen may be metallic, non-metallic, or a combination thereof and the catalyst must have multiple oxidation states. That is the catalyst must be able to shuffle electrons efficiently and rapidly between an oxidizer and the metal of a substrate metal function to catalyze CMP polishing. The catalysts are preferably metallic or non-metallic compounds. The term "metallic" refers to one or more metals in their elemental state. Typically, metallic catalysts will be incorporated into the polishing pad substrates as small metal particles. The term "non-metallic" as it is used herein refers to metals that are incorporated into a compound to form a metal compound in which the metal does not exist in its elemental state. Preferably, the catalyst is one or more soluble metal compounds including a metal having multiple oxidation states selected from the group including but not limited to Ag, Co, Cr, Cu, Fe, Mo, Mn, Nb, Nd, Ni, Os, Pd, Rh, Ru, Sc, Sm, Sn, Ta, Ti, V, W and combinations thereof The term "multiple oxidation states" refers to an atom or compound that has a valence number that is capable of being augmented as the result of a loss of one or more negative charges in the form of electrons. Most preferred catalysts are compounds of Ag, Cu and Fe and mixtures thereof. Especially preferred catalysts are compounds of Fe such as, but not limited to ferric nitrate.

The catalyst may be present in the polishing pad substrate in an amount sufficient to improve the polishing of a metal substrate layer when the pad is wetted with an aqueous solution having an oxidizing agent. Typically, this will require that the catalyst containing polishing pad be capable of supplying an amount of catalyst at the interface between the pad surface and the metal feature being polished in an amount ranging from about 0.0001 to about 2.0 weight percent. More preferably, the amount of catalyst at the metal surface interface will range from about 0.001 to about 1.0 wt %. In order to supply the requisite amount of catalyst at the pad surface/metal layer interface, the catalyst containing polishing pad should include an amount of catalyst ranging from about 0.05 to about 30.0 weight percent. It is preferred that the catalyst is present in the catalyst containing polishing pad in an amount ranging from about 0.5 to about 10.0 weight percent, most preferably in an amount ranging from about 1.0 to about 5.0 weight percent. At this preferred catalyst loading level, and when an oxidizing agent such as hydrogen peroxide, urea hydrogen peroxide, or monopersulfate is used, the chemical mechanical polishing process becomes essentially metal and "metallic ion free."

The concentration ranges of catalyst in the polishing pad substrate or at the pad/metal surface interface are generally reported as a weight percent of the entire compound. The use of high molecular weight metal containing compounds that comprise only a small percentage by weight of catalyst is well within the scope of catalysts useful in this invention. The term catalyst when used herein also encompasses compounds wherein the catalytic metal comprises less than 10% by weight of the metal in the composition and wherein the metal catalyst concentration at the pad metal interface is from about 2 to about 3000 ppm of the overall composition weight.

The oxidizing agent used in conjunction with the catalyst containing polishing pads of this invention should have an electrochemical potential greater than the electrochemical potential necessary to oxidize the catalyst. For example, an oxidizing agent having a potential of greater than 0.771 volts versus normal hydrogen electrode is necessary when a hexa aqua iron catalyst is oxidized from Fe(II) to Fe(III). If an aqua copper complex is used, an oxidizing agent having a potential of greater than 0.153 volts versus normal hydrogen electrode is necessary to oxidize Cu(I) to CU(II). These potentials are for specific complexes only, and may change, as will the useful oxidizing agents, upon the addition of additives such as ligands (complexing agents) to the compositions of this invention.

The oxidizing agent is preferably an inorganic or organic per-compound. A per-compound as defined by Hawley's Condensed Chemical Dictionary is a compound containing at least one peroxy group (—O—O—) or a compound containing an element in its highest oxidation state. Examples of compounds containing at least one peroxy group include but are not limited to hydrogen peroxide and its adducts such as urea hydrogen peroxide and percarbonates, organic peroxides such as benzoyl peroxide, peracetic acid, and di-t-butyl peroxide, monopersulfates ($SO_5^{=}$), dipersulfates ($S_2O_8^{=}$), and sodium peroxide. Examples of compounds containing an element in its highest oxidation state include but are not limited to periodic acid, periodate salts, perbromic acid, perbromate salts, perchloric acid, perchloric salts, perboric acid, and perborate salts and permanganates. Examples of non-per compounds that meet the electrochemical potential requirements include but are not limited to bromates, chlorates, chromates, iodates, iodic acid, and cerium (IV) compounds such as ammonium cerium nitrate.

Most preferred oxidizing agents are hydrogen peroxide and its adducts, monopersulfates, and dipersulfates.

The catalyst containing polishing pads of this invention are used with at least one oxidizing agent to planarize metal features associated with electrical substrates such as integrated circuits. The electrical substrates may include one or more metal features. Each metal feature on the surface of the substrate may be selected from any metals and alloys that are useful in the manufacture of electronic substrates. Preferably, the metals features include a metal selected from the group consisting of titanium, titanium alloys, titanium nitride, tungsten, tungsten alloys, copper, copper alloys, tantalum, tantalum alloys, and combinations thereof The catalyst of the catalyst containing polishing pad of this invention operates with an oxidizing agent to promote efficient chemical mechanical polishing of a metal surface. Generally, the catalyst containing polishing pad will be brought into contact with the metal surface being polished and the pad will be moved in relationship to the metal surface. The oxidizing agent, typically introduced as an aqueous solution, must be present at the interface between the catalyst containing polishing pad surface and the metal layer being polished to allow the catalyst to catalyze the oxidization of the metal feature surface by the selected oxidizing agent.

The oxidizing agent may be used alone in a polishing composition or in combination with other polishing composition additives. Typically, the oxidizing agent will be present in an aqueous polishing solution in an amount ranging from about 0.5 to about 50.0 weight percent. It is preferred that the oxidizing agent is present in a solution that is applied to the pad/metal feature interface to provide an amount of oxidizing agent at the pad interface in an amount ranging from about 1.0 to about 10.0 weight percent. For purposes of this application, the amount of oxidizing agent, catalyst or any other ingredient at the pad/metal feature interface is determined by measuring the concentration of the catalyst, oxidizing agent, etc. in the polishing composition at point exiting the polishing machine being used.

Other well known polishing composition additives may be incorporated alone or in combination into the chemical mechanical polishing composition of this invention. Such additives include inorganic acids, organic acids, surfactants, alkyl ammonium salts or hydroxides, dispersing agents, film forming agents, inhibitors, polishing accelerators, and so forth.

In order for chemical mechanical polishing to proceed most efficiently, an abrasive is commonly used to mechanically remove chemically modified materials from the surface of a the metal layer being polished. The abrasive may be incorporated into a solution (with or without oxidizing agent) that is applied to the interface between the catalyst containing polishing pad on the metal substrate surface, the abrasive may be incorporated into the catalyst containing polishing pad, or a combination of both abrasive delivery methods may be used. The abrasive is typically a metal oxide abrasive. The metal oxide abrasive may be selected from the group including alumina, titania, zirconia, germania, silica, ceria and mixtures thereof The solution or catalyst containing polishing pad preferably includes from about 1.0 to about 20.0 weight percent or more of an abrasive. It is more preferred, however, that the abrasive solution or polishing pad includes from about 3.0 to about 6.0 weight percent abrasive with silica being the most preferred abrasive.

The catalysts may be incorporated into the polishing pad substrate by any method known in the art for incorporating a solid particulate or liquid material into a polymeric substrate in a manner that allows for leaching, evolution or exposure of the catalyst from a polymeric substrate. Examples of methods for incorporating the catalyst into a polishing pad substrate include encapsulation, incorporation of time release catalyst particles into the polishing pad substrate, impregnation, creating a polymer/catalyst complex, incorporating the catalyst as a small molecule into the polishing pad substrate polymer matrix, introducing the catalyst as a salt into the polishing pad substrate during its manufacture, incorporating a soluble or leachable form of catalyst into the polishing pad substrate, or any combinations of these methods. The selection of the method for incorporating a catalyst into a polishing pad substrate will, of course, depend upon the catalyst chosen. If the catalyst is a metallic particulate catalyst, then the catalyst will typically be incorporated into the polishing pad substrate by impregnation or during the pad manufacture.

In one method for incorporating a catalyst in the form of a soluble or insoluble metal compound into a polishing pad substrate, the catalyst maybe encapsulated within void spaces created during the manufacture of the pad substrate polymer matrix as an insoluble, semi-soluble or soluble material. Alternatively, the catalyst may be incorporated into the polymer precursor before it is polymerized into a matrix thereby allowing the pad substrate polymer to integrate and secure the catalyst in the polymer matrix.

Another alternative is to incorporate a soluble metal catalyst into time release particles and incorporate the time release catalyst particles in the pad substrate by encapsulation as described above. Typically, a time release catalyst particle will comprise a soluble metal catalyst surrounded by or incorporated into a pH dependent binder. The soluble metal catalyst is liberated by contacting the catalyst containing polishing pad with a solution having a pH that solubilizes the pH dependent binder to controllably release the catalyst over time during the polishing process.

In yet another alternative, the catalysts of this invention can be incorporated into a pad substrate after the pad substrate has been manufactured. One method for incorporating the catalyst into a premanufactured pad substrate is by impregnating the pad with a catalyst using conventional impregnation techniques. Impregnation can be accomplished by preparing a catalyst solution and applying the catalyst solution to the polishing pad and thereafter drying the polishing pad. One advantage of the impregnation technique is that the pads can be reimpregnated with catalyst once the catalyst in the catalyst containing polishing pad has been depleted to the point where it is no longer effective. This way, the polishing pad can be reused until the polishing pad substrate fails.

Catalyst containing polishing pads of this invention are used to planarize substrate metal features during the manufacture of integrated circuits. The term "metal feature" refers to an exposed metal portion of the substrate surface being polished. A substrate may include one or more metal features. The term "metal feature" also encompasses substrates wherein the entire surface of the substrate is comprised of a single metal or alloy.

The catalyst containing polishing pads are used in conjunction with a polishing machine and then brought into contact with the surface being polished. Typically, an aqueous solution or polishing composition including an oxidizing agent will be applied to the pad either before the pad is brought into contact with the substrate surface being polished, during the period of time the catalyst containing polishing pad is brought into contact with the substrate surface being polished, or both. Alternatively or in addition to the methods described immediately above, the aqueous polishing solution or composition can be applied directly to the substrate surface where its reaction with the metal surface is catalyzed by the catalyst in the catalyst containing polishing pad. As mentioned above, an abrasive may optionally be incorporated into the oxidizing agent solution or an abrasive may be incorporated into the catalyst containing polishing pad. Once the catalyst containing polishing pad, the oxidizing agent and the optional abrasive are located at the polishing pad/substrate interface, the catalyst containing polishing pad is moved in relationship to the metal containing substrate layer to planarize the metal layer. When the planarization is complete, the catalyst containing polishing pad is removed from contact with the substrate surface.

EXAMPLE 1

This Example evaluated the polishing performance of pads with and without catalysts. The pad used was a IC1000 polishing pad manufactured by Rodel. The pad was used to polish 1 inch square cut sections of silcon wafers with a tungsten film deposition. In the first set of tests, a polishing slurry including 5 wt % silica and 4 wt % hydrogen peroxide was used. The polishing was performed on a table top polishing machine manufactured by Struers, West Lake, Ohio. The table top polishing machine included a Rotopol 31 base and a Rotoforce 3 downforce unit. The platen speed was 150 rpm. The polishing carrier speed was 150 rpm and the slurry flow rate was 100 ml/min. The polishing force used was 50 n. Five wafers were tested under these conditions and the average polishing rate was 270 Å/min.

The same polishing pad was then soaked in 10 wt % solution of a catalyst of ferric nitrate. The polishing pad was then used to polish seven 1 inch square cut sections of wafers using the polishing slurry, polishing machine, and the polishing conditions described above. 7 wafers were polished in this run with an average polishing rate of 652 Å/min.

In a third run, the same polishing pad was again soaked in a 10 wt % solution of a catalyst of ferric nitrate for approximately 18 hours and then allowed to dry for 24 hours. The pad was then conditioned after the drying period and prior to polishing. The pad was used to polish 5 wafers at an average polishing rate of 489 Å/min The polishing results indicate that using a polishing pad including a catalyst, in this instance, ferric nitrate catalyst, to polish a substrate layer provides improved polishing results in comparison to polishing pad without a catalyst.

It is understood that the present invention is not limited to the particular embodiments shown and described herein, but that various changes may be made without departing from the scope of the invention.

What we claim is:

1. A polishing pad useful for chemical mechanical polishing comprising:

a polishing pad substrate; and at least one catalyst having multiple oxidation states.

2. The polishing pad of claim 1 wherein the catalyst catalyzes the reaction of an oxidizing agent and the metal of a substrate metal feature being polished.

3. The polishing pad of claim 1 wherein the catalyst is soluble.

4. The polishing pad of claim 3 wherein the soluble catalyst is present in the pad in an amount sufficient to improve the polishing of a metal substrate layer when the pad is used with an aqueous polishing composition including an oxidizing agent.

5. The polishing pad of claim 1 wherein the catalyst is a soluble metal catalyst.

6. The polishing pad of claim 5 wherein the soluble metal catalyst is a compound including a metal selected from the group consisting of Ag, Co, Cr, Cu, Fe, Mo, Mn, Nb, Nd, Ni, Os, Pd, Pt, Rh, Ru, Sc, Sm, Sn, Ta, Ti, V, W and mixtures thereof.

7. The polishing pad of claim 5 wherein the soluble metal catalyst is a compound of iron, copper, silver, and any combination thereof having multiple oxidation states.

8. The polishing pad of claim 5 wherein the soluble metal catalyst is an iron compound selected from the group consisting of inorganic iron compounds and organic iron compounds.

9. The polishing pad of claim 8 wherein the iron compound is ferric nitrate.

10. The polishing pad of claim 1 including from about 0.05 to about 30.0 weight percent catalyst.

11. The polishing pad of claim 1 including from about 0.5 to about 10.0 weight percent catalyst.

12. The polishing pad of claim 5 including a sufficient amount of soluble metal catalyst to deliver an amount metal from the soluble metal catalyst at a pad/substrate interface from about 0.0001 to about 2.0 wt % when the pad is used with an aqueous polishing composition.

13. The polishing pad of claim 2 wherein the oxidizing agent is hydrogen peroxide.

14. The polishing pad of claim 2 wherein the oxidizing agent is selected from the group consisting of monopersulfates, persulfates and mixtures thereof.

15. The polishing pad of claim 1 wherein the pad includes at least one abrasive.

16. A polishing pad useful for chemical mechanical polishing comprising:

a polishing pad substrate; and a soluble catalyst having multiple oxidization states that catalyzes the reaction between an oxidizing agent and the metal of a substrate metal feature, wherein the catalyst is selected from iron compounds, copper compounds and mixtures thereof.

17. The polishing pad of claim 16 including an abrasive.

18. The polishing pad of claim 17 wherein the abrasive is at least one metal oxide.

19. The polishing pad of claim 18 wherein the metal oxide abrasive is selected from the group including alumina, ceria, germania, silica, titania, zirconia, and mixtures thereof.

20. A method for polishing metal on a substrate surface including at least one metal layer comprising the steps of:

a. preparing a polishing pad by combining a polishing pad substrate with at least one catalyst having multiple oxidation states that catalyzes the reaction between a oxidizing agent and the metal of a substrate metal feature;

b. applying a solution including an oxidizing agent to the polishing pad; and c. removing at least a portion of the metal from the substrate metal feature by moving the polishing pad in relation to the substrate metal feature.

21. The method of claim 20 wherein the solution including the oxidizing agent is applied to the polishing pad at a time during the polishing method selected from (i) before the polishing pad is used to remove at least a portion of the metal, (ii) when the polishing pad is used to remove at least a portion of the metal, or the combination of (i) and (ii).

22. The method of claim 20 wherein the catalyst is a particulate metal catalyst.

23. The method of claim 22 wherein the polishing pad includes from about 0.5 to about 30.0 wt % of the particulate metal catalyst.

24. The method of claim 22 wherein the particulate metal catalyst is selected from the group consisting of particles of iron, particles of an iron containing alloy, particles of copper, particles of a copper containing alloy and mixtures thereof.

25. The method of claim 20 wherein the catalyst is a soluble metal catalyst.

26. The method of claim 25 wherein the soluble metal catalyst is present in the polishing pad in an amount ranging from about 0.5 to about 30.0 wt %.

27. The method of claim 26 wherein the soluble metal catalyst is a compound of iron, copper, silver, and any combination thereof having multiple oxidation states.

28. The method of claim 27 wherein the soluble metal catalyst is an iron compound selected from the group consisting of inorganic iron compounds and organic iron compounds.

29. The method of claim 20 wherein the substrate metal feature is a metal selected from the group consisting of tungsten, tungsten alloys, copper, copper alloys, tantalum, tantalum alloys, and combinations thereof.

30. The method of claim 20 wherein the substrate includes a second metal feature made from a metal selected from the group consisting of titanium, titanium nitride, and combinations thereof wherein at least a portion of the second metal feature is removed in step (c).

31. The method of claim 20 wherein the polishing pad substrate is impregnated with the catalyst.

32. The method of claim 20 wherein the polishing pad includes at least one abrasive.

33. The method of claim 32 wherein the abrasive is a metal oxide abrasive that is selected from the group consisting of alumina, ceria, germania, silica, titania, zirconia, and mixtures thereof.

34. The method of claim 20 wherein the solution including an oxidizing agent is an aqueous solution.

35. The method of claim 20 wherein the solution including an oxidizing agent further includes a particulate abrasive.

36. The method of claim 35 wherein the abrasive is a metal oxide abrasive that is selected from the group consisting of alumina, ceria, germania, silica, titania, zirconia, and mixtures thereof.

37. The method of claim 36 wherein the abrasive is silica.

38. The method of claim 20 wherein the oxidizing agent is an organic per compound, an inorganic per compound, a non-per compound including bromates, chlorates, chromates, iodates, iodic acid, cerium (IV) compounds, and mixtures thereof.

39. The method of claim 20 wherein the oxidizing agent is hydrogen peroxide.

40. The method of claim 20 wherein the oxidizing agent is selected from monopersulfate, persulfate and mixtures thereof.

* * * * *